United States Patent [19]

Kraus

[11] Patent Number: 4,579,524

[45] Date of Patent: Apr. 1, 1986

[54] CHARGE FORMING PREHEATING APPARATUS AND METHOD

[75] Inventor: Richard B. Kraus, Barrington, Ill.

[73] Assignee: General Kinematics Corporation, Barrington, Ill.

[21] Appl. No.: 549,826

[22] Filed: Nov. 9, 1983

[51] Int. Cl.[4] ..... F27D 3/00; F27D 3/004; F27B 3/04

[52] U.S. Cl. ..... 432/9; 266/901; 373/79; 432/163

[58] Field of Search ..... 432/9, 163, 179, 208; 266/142, 143, 276, 901; 373/79, 80, 81

[56] References Cited

U.S. PATENT DOCUMENTS

| | | | |
|---|---|---|---|
| 2,546,337 | 3/1951 | Gibson | 266/143 |
| 3,401,925 | 9/1968 | Evans et al. | 266/901 |
| 3,529,067 | 9/1970 | Grott | 266/901 |
| 3,529,733 | 9/1970 | Walzel | 266/901 |
| 3,589,692 | 6/1971 | Lakin | 432/9 |
| 3,802,830 | 4/1974 | Reinbold et al. | 432/9 |
| 3,813,209 | 5/1974 | Venetta | 266/901 |

*Primary Examiner*—John J. Camby
*Attorney, Agent, or Firm*—Wood, Dalton, Phillips, Mason & Rowe

[57] ABSTRACT

A method for distributing, drying and heating a selected mix and weight of metals prior to melting in a furnace, including the steps of placing weights of selected metals in a feeder car according to a predetermined distribution, locating the feeder car beneath the hood of a heater, closing the hood over the car, heating the enclosed metal and transferring the preheated metal from the car to a charge bucket for a furnace. An apparatus is disclosed which includes a feeder car movable between a loading station and a heating and dumping station. A weigh hopper is used for measuring and distributing the selected weights and mix of metals which are then loaded in the feeder car. A hood is adapted to close over the feeder car and seal thereto after which a heater is provided to inject heat through the hood into the enclosed car. A vibratory conveyor is provided which moves the preheated metals from the feeder car into a charge bucket for a furnace.

10 Claims, 4 Drawing Figures

CHARGE FORMING PREHEATING APPARATUS AND METHOD

BACKGROUND OF THE INVENTION

1. Technical Field

This invention relates to a method and apparatus for preheating a charge of metal before loading into a furnace.

2. Background Art

In applications where it is desirable to melt metal, as for example in foundries where casting is done, the metals which are used in forming the casting are typically melted in a gas fired or an induction furnace. The charge is dumped into a furnace crucible where it is melted. However, dumping cold metals into a furnace crucible can cause the furnace temperature to be drastically reduced, and is thereby detrimental to the furnace efficiency. Further, when cold metals are dumped into molten metal, there is a danger of explosion, because of the moisture which may be present in such cold metals.

Also, different applications require different mixtures of metals and it is necessary to measure the quantities of each metal being melted. In many cases, a particular composition is first approximated in a batch which is melted, and then samples of that batch are analyzed to determine what adjustments need be made to obtain the desired composition. A selected mix and weight of metals is then added to make the necessary adjustments. However, making these adjustments involves the same drawbacks as discussed above.

The present invention is directed toward overcoming one or more of the problems as set forth above.

SUMMARY OF THE INVENTION

In one aspect of the present invention, a method is disclosed for measuring and distributing by weight, density and mass a selected mix and weight of metals to form a charge which is then heated and dried prior to melting in a furnace. This method includes the steps of selecting the distribution of metals needed, placing selected weights of metals in a feeder car in the predetermined distribution order, locating the feeder car beneath the hood of a heater, closing the hood over the car, heating the enclosed metal and transferring the preheated metal from the car to a furnace charge bucket for movement to a furnace.

An apparatus is disclosed which can be used to perform the method and includes a feeder car movable between a loading station and a heating and dumping station. A weigh hopper is used for measuring and distributing in the predetermined sequence the selected weights and mix of metals which are then collected in the feeder car. A hood is adapted to close over the feeder car and a heater is provided to inject heat through the hood into the enclosed feeder car. A vibration generator is provided which moves the preheated metals out of the feeder car and into a furnace charge bucket for movement to a furnace.

With the disclosed method and apparatus for preheating and drying of metal prior to introducing it to the furnace or furnace crucible, the efficiency and capacity of the furnace is improved and the dangers of explosion are eliminated.

DESCRIPTION OF THE PREFERRED EMBODIMENT

Figure 1:
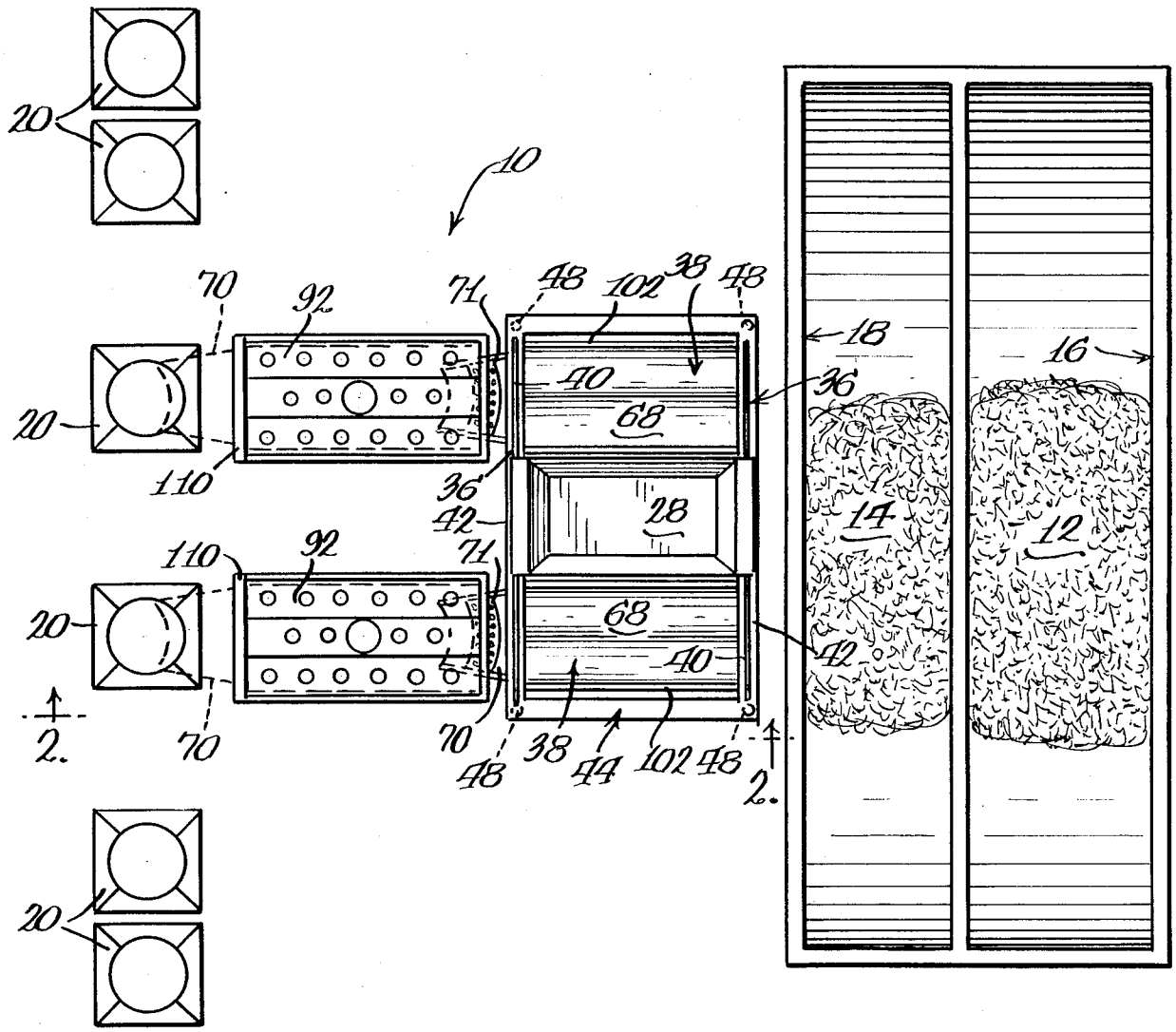
FIG. 1 is a plan view of the preheating system according to the invention.

A preheating apparatus 10 of the present invention as illustrated in the figures is used to select a mix of metals (e.g. recovered steel scrap 12 and cast returns 14 or other metallics) from their respective bins 16,18, and then preheat the metals before transferring them to a furnace charge bucket 20. Only two bins 16,18 are shown, though any number could be used, dependent upon the number of different types of metals used. The charge buckets or loaders 20 (see FIGS. 1, 2 and 4) are positioned to receive the preheated metals and when the charge buckets are loaded they move to the furnace (not shown). It is apparent that the present system 10 can be used with a number of different charge buckets 20.

A trolley 24 (see FIG. 2) is supported for movement along an overhead track 26 above a weigh hopper 28 and the metal bins 16,18. The trolley carries an electromagnet 30 which may be lowered into the desired bin 16,18 and energized to pick up a quantity of the desired metal 12 or 14, and then de-energized when located over the weigh hopper 28 to dump the metal 12 or 14 into the hopper 28. The sequence or order of pickup of the selected metal is important as is the weight of each metal and the combination of metals. The sequence or order of pickup of the metals determines the distribution of the metals in the charge bucket. That is, the less dense metals are placed at the bottom of the hopper or at the front of the hopper with the more dense metals on top or to the rear of the less dense metal so that upon dumping the charge into the feeder car and ultimately in the charge bucket the less dense metal will be on the bottom for first entry into the crucible in a furnace.

Figure 2:
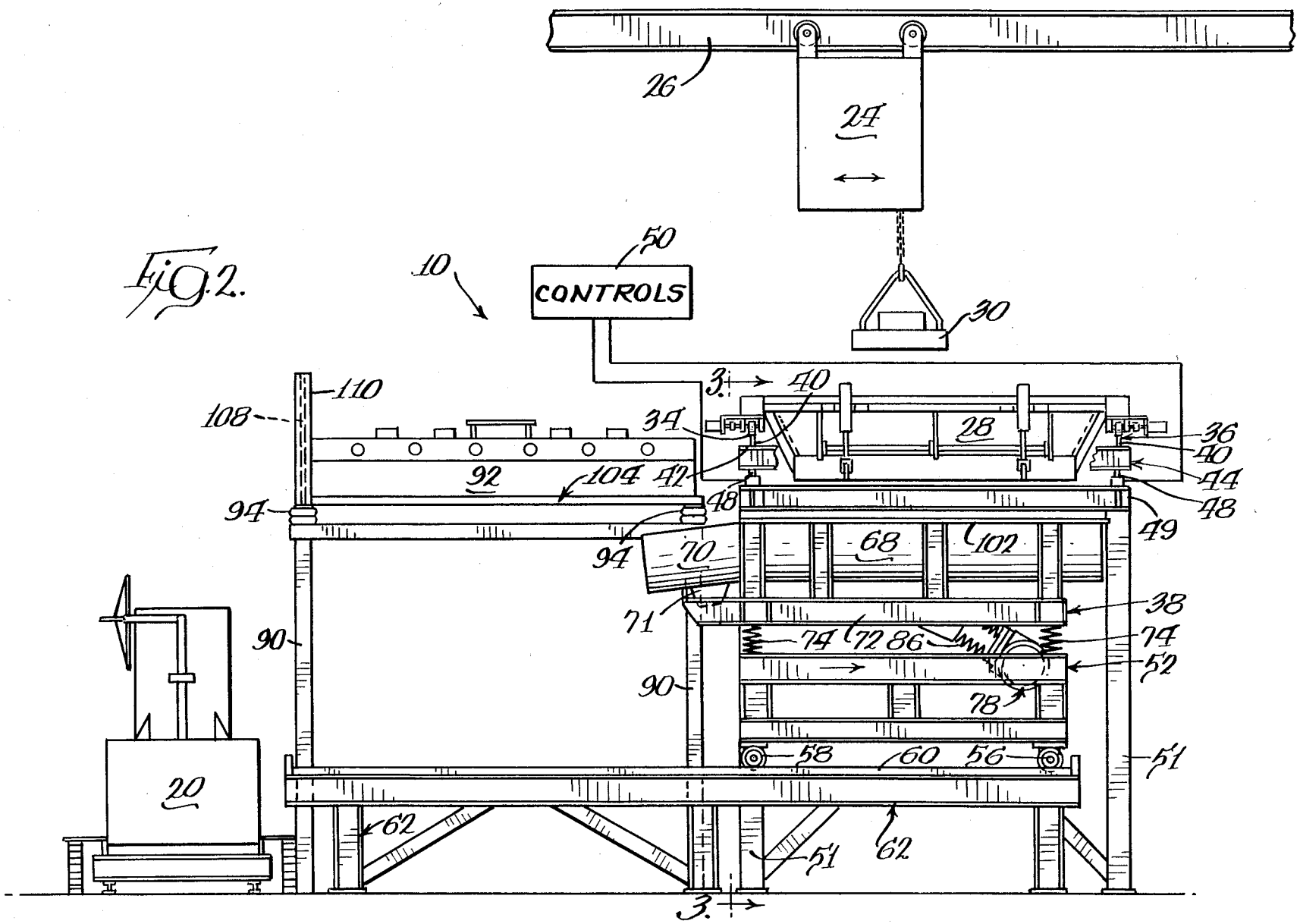
FIG. 2 is a partial side view of the system taken along line 2—2 of FIG. 1.
Figure 3:
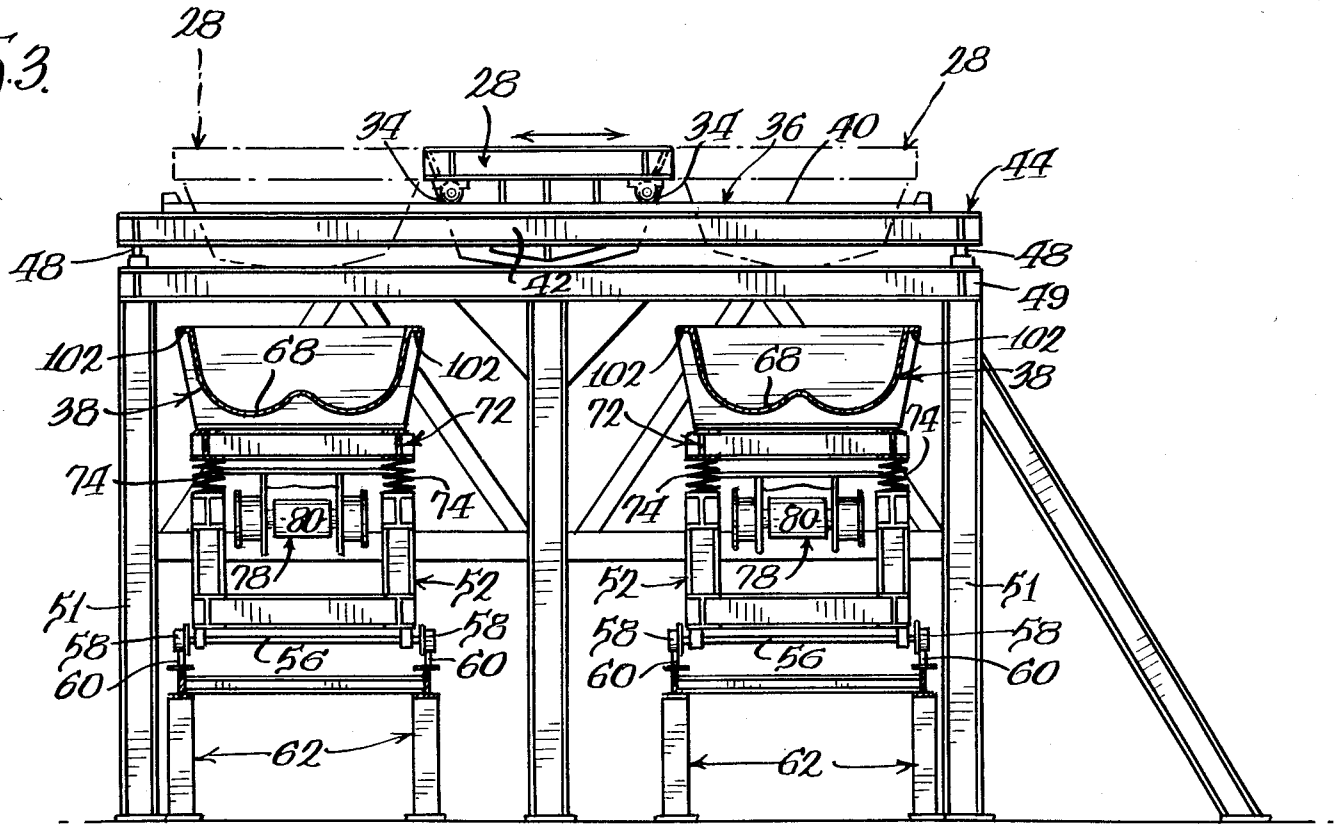
FIG. 3 is a cross-sectional view of a portion of the system taken along line 3—3 of FIG. 2.

The weight hopper 28 is supported on wheels 34 on a track 36 so that the hopper 28 can move back and forth in a transverse direction to locate it above either of two feeder cars 38 (see FIG. 3). The track 36 comprises a rail 40 along both transverse beams 42 of a frame 44 and the wheels 34 are flanged to ride on the rails 40. The frame 44 is supported on its four corners on load cells 48 which measure the weight of metallic charge and feeds that information into a suitable control 50 as shown in FIG. 2. The load cells 48 are mounted on a support frame 49 supported by columns 51 anchored to the floor or foundation.

The control 50 may include a scoreboard-type monitor which will display several multiple digit numbers, each multiple digit number having one digit which is an ingredient identification digit and additional digits (i.e. 4 digits) which are the metallic weight requirement to be charged. Accordingly, if a mix of 4,000 lbs. of steel scrap 12 and 6,000 lbs. of cast returns 14 is desired, the electromagnet 30 can be used to transfer steel scrap 12 from bin 16 until the load cells 48 register a weight of 4,000 lbs. which will show on the monitor as a descending weight, that is, the monitor shows the weight needed to meet the ingredient requirements and as the ingredient is added to the weigh hopper 28, the weight will be deducted from that required with the monitor showing the amount still needed. When all of the desired ingredient has been added to the hopper, the monitor will flash when within allowable tolerances. The electromagnet 30 will then be used to transfer cast returns 14 from bin 18 until the load cells 48 register the requisite amount of that ingredient. When the total batch weight required has been satisfied for all ingredients, the monitor will de-illuminate.

The bottom of the weigh hopper 28 is hinged or otherwise openable so that the metal in the hopper 28 may be dumped into one of the feeder cars 38 when the hopper 28 is located over one or the other.

Figure 4:
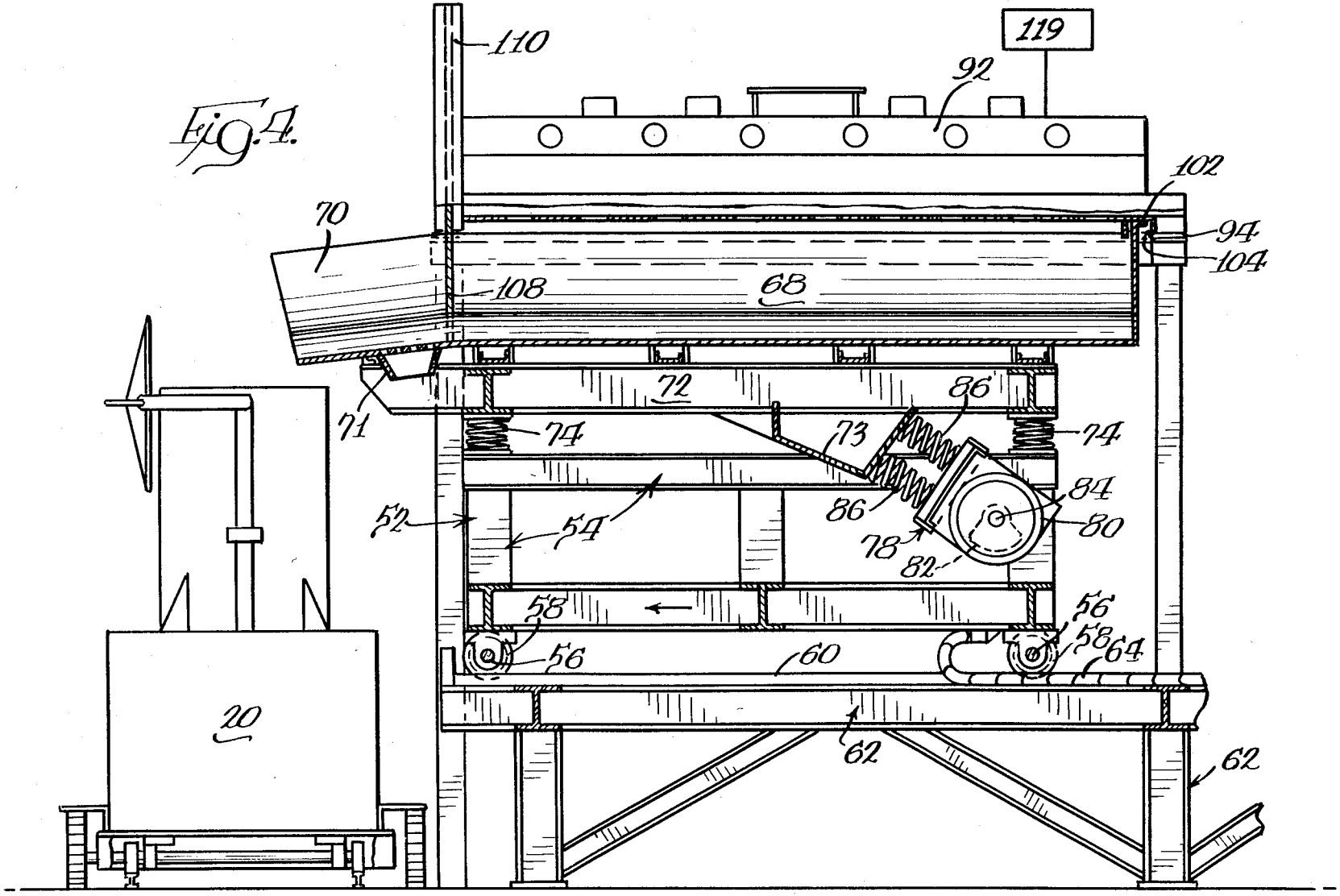
FIG. 4 is a cross-sectional view of a portion of the system in the heating and dumping position.

The feeder cars 38 each have an appropriate carriage frame 52. The carriage 52 is supported on a pair of axles 56 having flanged wheels 58 which roll along rails 60 suitably supported by a rigid structure 62 anchored on the floor or foundation. The cars 38 move over the rails 60 between a loading station (FIG. 2) where they can be loaded from the weigh hopper 28 and a heating and dumping station (FIG. 4). The weigh hopper 28 and feeder cars 38, in the illustrated embodiment are driven along their tracks by hydraulic motors which are powered by hydraulic fluid from a separate source. The fluid is conveyed to the motors through flexible track members 64 (see FIG. 4) which members protect the power supply and control connections for the drive as the hopper and cars are moved back and forth between these various stations. The weigh hopper 28 and feeder cars 38 may also be driven in any other suitable manner such as by a chain drive or other mechanical apparatus.

Each feeder car 38 includes a trough 68 open to a chute 70 on the forward end and rigidly fixed to a frame 72 supported on its four corners by springs 74 mounted on the carriage frame 52. The chute 70 has a grizzly screen separator 71 formed in the midportion thereof to permit small particles (such as dirt and the like) to be separated from the batch. The separator 71 has graded openings which permit dirt and small particles to fall through.

A vibration generator 78, comprising an electric motor 80 having aligned eccentric weights 82 on opposite ends of its shaft 84, is carried by the frame 72 and has springs 86 extending upwardly and forwardly from the vibration generator 78 to a bracket 73 on the trough frame 72 as best seen in FIG. 4. The vibration generator 78 thereby creates a two mass system which will create vibrations when energized to cause the materials in the trough 68 to move forward and down the chute 70.

Supported on posts 90 above the forward end of the rails 60 is a hood 92 of a preheater. The hood 92 is supported on its corners by bellows 94 which raise the hood 92 when they are inflated (see FIG. 2) and lower the hood 92 when they are deflated (see FIG. 4).

When the bellows 94 are inflated, the hood 92 is supported at a height which allows the feeder car 38 to move underneath it. When the car 38 is thus positioned beneath the hood 92 in the heating station, the bellows 94 are deflated to close the hood 92 over the car 38 as shown in FIG. 4. The trough 68 of the feeder car 38 includes an outwardly extending flange 102 on which the hood 92 can rest. The flange 102 is received in a downwardly open U-groove 104 around the edge of the hood 92 so that a seal is formed between the hood 92 and the car 38 as shown in FIG. 4. The bellows 94 when deflated actually engages the base of the U-shaped groove 104 against the flange 102 an amount sufficient to depress the springs 74 supporting the frame 72, in this way creating a positive seal between the hood and the car. A gate 108 is located at the forward end of the hood 92 and may be raised or lowered within an upright frame 110. The gate 108 matches the shape of the trough 68 so as to close off the forward end of the trough 68 when it is lowered. Accordingly, the trough 68, hood 92 and gate 108 form an enclosure for the metals when the car 38 is at the heating station, and heat from a suitable source can be introduced through the hood 92 to thereby efficiently preheat and dry the enclosed metals. Also, because the metal is enclosed, the atmosphere is controlled so as to eliminate ambient influence, and either an oxidizing or reducing flame can be used as desired.

The system 10, as illustrated, includes two feeder cars 38 and hoods 92, as can be seen in FIGS. 1 and 3, to permit efficient use of the electromagnet 30 and weigh hopper 28. The two cars 38 will thus alternate in operation so that, while the metals in one car 38 are being heated, the weigh hopper 28 measures out and dumps metals into the second car 38. When that is completed and the second car 38 is moved to the heating station, the weigh hopper 28 measures out and then dumps metals into the first car 38 once it has returned to its loading station. Of course, depending upon the operating cycles of each car 38 and the weigh hopper 28, three cars or even more can be provided with a single trolley 24, electromagnet 30 and weigh hopper 28.

Operation of the system 10 is thus as follows. The electromagnet 30 is moved between the bins 16,18 and the weigh hopper 28 until a charge containing the desired mix, weight and distribution of metals are in the weigh hopper 28 as measured by the load cells 48. The weigh hopper 28 is then moved to one of the feeder cars 38 and the charge of metals is dumped into the car 38. The car 38 is then moved forward to its heating station, the gate 108 is lowered and the bellows 94 deflated to lower the hood 92. With the charge of metals thus enclosed, heat is introduced to preheat and dry the metals. The heating can be accomplished using any of a number of conventional heating structures shown schematically in FIG. 4 with the reference numeral 119. Once that is completed, the heat is shut off, the gate 108 is raised and the bellows 94 are inflated to raise the hood 92. The car 28 remains in the same position and the vibration generator 78 is energized to cause the metal to move out the front, across the grizzly separator 71 and through the chute 70 so as to be dumped into the waiting charge bucket 20. The charge bucket 20 then transports the preheated and dried metals to the furnace.

Preheating the metals before locating them in the furnace is desirable for a number of reasons. It increases the capacity of the furnace and thus reduces melt cycle times for the metal. It keeps the furnace temperature from being drastically reduced by the introduction of cold metals. Further, it avoids the danger of explosion which arises when cold metals are dumped into molten metal in the crucible. Preheating further dries the metals, again avoiding the danger of explosion created by adding moisture to molten metals.

Other aspects, objects and advantages of the present invention can be obtained by a study of the drawings, the specification and the appended claims.

I claim:

1. A method for distributing, drying and heating a selected mix and weigh of metals prior to melting in a furnace, comprising the steps of:

placing selected weights of selected metals from a charge weigh hopper in a feeder car according to a predetermined order of distribution to form a charge of metal;

locating said feeder car with the charge of metal beneath a hood of a heater;

closing the hood over the charge of metal in the car;

heating the charge of metal; and transferring the preheated charge of metal through a vibratory conveying action from the feeder car to a charge bucket for movement to the furnace.

2. The method of claim 1 wherein the charge of metal is placed in the feeder car by transferring selected weights of metals from bins to the weigh hopper according to a predetermined distribution.

3. An apparatus for distributing, drying and heating a selected mix and weight of metals and transferring the metals to a charge bucket or melting furnace, comprising:

a charge weigh hopper;

a feeder car having vibratory conveying means for advancing the metals from the feeder car into the charge bucket or melting furnace;

means for loading the feeder car from the charge weigh hopper with the selected distribution, mix and weight of metals;

means for moving the feeder car between a loading station and a heating station;

a hood adapted to close over the feeder car when the car is moved to the heating station; and means for injecting heat into the charge in the car mounted feeder whereupon the vibratory conveying means is activated for vibrating the metals in the feeder car for unloading the heated metals from the feeder car into the charge bucket or melting furnace.

4. The apparatus of claim 3, wherein the loading means comprises:

means for transferring metals according to an order of distribution from selected bins to the weigh hopper, said weigh hopper measuring the weight of transferred metals to provide the selected mix and weight; and means for dumping the metal from the weigh hopper into the feeder car.

5. The apparatus of claim 4, wherein the means for transferring metals comprises an electro magnet carried by a trolley movable between the bins and the weigh hopper.

6. The apparatus of claim 4 further comprising:

a second feeder car movable between a second loading station and a second heating and dumping station;

a second hood adapted to close over the second feeder car when the car is in the second dumping station;

means for injecting heat through the second hood into the enclosed second feeder car;

means for dumping metal from the second feeder car into a charge bucket when the second feeder car is in the second dumping station; and means for dumping the selected mix and weight of metals into either the first or second feeder cars from the weigh hopper.

7. The apparatus of claim 3 wherein vibratory conveyor means are provided on each feeder car, each vibratory conveyor means advancing the metal from the associated car to a chute opened into the charge bucket.

8. The apparatus of claim 7 wherein a screen separator is located in the chute to separate dirt from the metal in the feeder car.

9. The apparatus of claim 7 wherein the feeder car is open at one end with a chute extending downwardly therefrom, and further comprising a gate associated with the hood for closing the forward end of the feeder car which together with the hood encloses the car when heat is injected.

10. The apparatus of claim 6 wherein said means for dumping the metals from the weight hopper into one of the feeder cars comprises a track lying transverse to the direction of movement of the trolley and supported above the first and second loading stations, and a door on the bottom of the weigh hopper which opens to drop the metal in the weigh hopper into a selected one of the feeder cars.

* * * * *